US007973485B1

(12) United States Patent
Brown et al.

(10) Patent No.: US 7,973,485 B1
(45) Date of Patent: Jul. 5, 2011

(54) PARTICLE CONTROLLER

(75) Inventors: Sammy Karl Brown, San Francisco, CA (US); Alok Mohan, Kettering, OH (US)

(73) Assignee: Silicon Accelerators, Inc, Athens, GA (US)

( * ) Notice: Subject to any disclaimer, the term of this patent is extended or adjusted under 35 U.S.C. 154(b) by 338 days.

(21) Appl. No.: 12/154,280

(22) Filed: May 20, 2008

(51) Int. Cl.
*G21K 1/00* (2006.01)
*G21K 5/00* (2006.01)
*H05H 1/54* (2006.01)

(52) U.S. Cl. ..... 315/111.61; 315/500; 315/5.41; 250/396 R; 313/360.1

(58) Field of Classification Search ..... 250/396 R; 315/111.61, 500, 5, 41; 313/360.1; 700/121
See application file for complete search history.

(56) References Cited

U.S. PATENT DOCUMENTS 3,903,424 A * 9/1975 Rose ..... 250/515.1
2009/0302785 A1 * 12/2009 Miller et al. ..... 315/505
* cited by examiner

*Primary Examiner* — Nikita Wells

(57) ABSTRACT

A particle controller is disclosed. In some embodiments, a particle controller includes an input port configured to receive a particle stream and a set of cells configured to form a tube through which at least a portion of the particles comprising the particle stream are directed. In some such cases, each cell in the set of cells comprises at least a portion of a semiconductor die.

20 Claims, 11 Drawing Sheets

PARTICLE CONTROLLER

BACKGROUND OF THE INVENTION

Many potential applications in a variety of fields exist for particle acceleration. However, traditional linear accelerators are very large and expensive to build and, thus, are not scalable. Therefore, there exists a need for smaller and more scalable devices to control particle beams so that, for example, particle acceleration can be made readily available to a variety of applications.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Figure 1A:
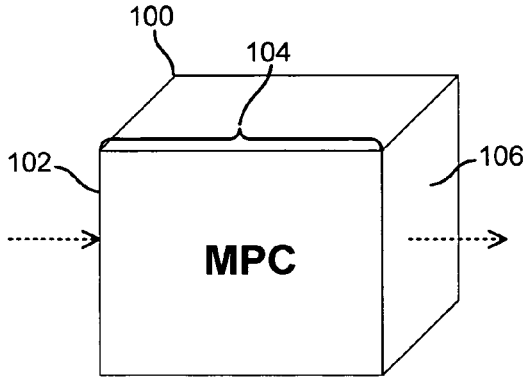
FIGS. 1A-1D are diagrams illustrating an embodiment of a particle controller.
Figure 1B:
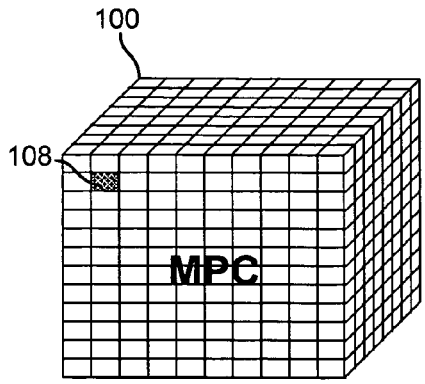
Figure 1C:
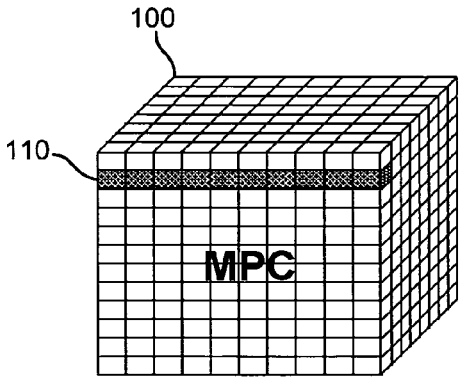
Figure 1D:
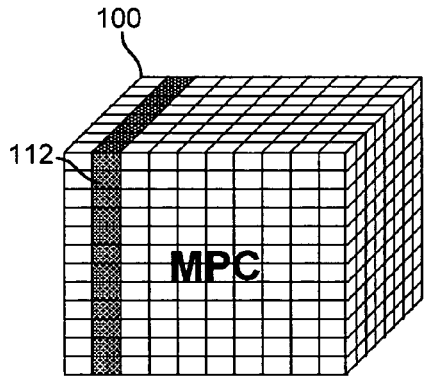

FIGS. 1A-1D are diagrams illustrating an embodiment of a particle controller. In some embodiments, the particle controller comprises a micro-level plasma controller (MPC). An MPC may be employed, for example, to accelerate plasmas over relatively short distances. In some embodiments, an MPC comprises a semiconductor device such as an integrated circuit or chip. Although an MPC is described in some of the given examples, the techniques described herein may be employed with respect to any type of particle controller. FIG. 1A is a block diagram illustrating an embodiment of an MPC. One or more charged particle streams are input into MPC 100 via one or more input ports included on surface 102 of MPC 100, directed through length 104 of MPC 100, and output as one or more particle beams via one or more output ports included on surface 106 of MPC 100. As further described below, the particles travel through one or more parallel hollow tubes that span length 104. In some embodiments, MPC 100 may be employed in a manner similar to a particle (e.g., linear) accelerator, e.g., to accelerate a plasma beam to higher energy levels. A silicon-based MPC can be constructed to have dimensions in centimeters or millimeters. As depicted in FIG. 1B, in some embodiments, MPC 100 comprises a three-dimensional matrix of cells, such as cell 108. In some embodiments, an MPC, such as MPC 100, may be constructed from a plurality of building blocks (e.g., plates) which when combined produce the matrix of cells of the MPC. In some embodiments, a cell of an MPC establishes an electromagnetic field to accelerate a beam of charged particles in the plasma state that travels through it. Changing the direction of the electromagnetic field relative to the cell walls can alter the direction of the beam traveling through the cell. Multiple cells may be used together to form a lens capable of focusing a beam of charged particles. In some embodiments, adjacent cells along length 104 of MPC 100 are connected or used in series to form a micro-level accelerator (MLA), such as MLA 110 depicted in FIG. 1C. Each cell included in a given MLA comprises one stage of the accelerator. Charged particles enter the first stage (e.g., via an input port on surface 102), accelerate through the middle stages, and exit the last stage (e.g., via an output port on surface 106). MPC 100 may include multiple parallel MLAs. The cells of a set of parallel MLAs that are associated with a particular stage comprise a plate of the MPC, such as plate 112 depicted in FIG. 1D. In some embodiments, an MPC is constructed by individually fabricating the plates comprising the stages of the MLAs and stacking them together. Each cell of a plate is associated with a different and possibly independent MLA and, thus, can be configured to operate independently of the other cells in the plate. In various embodiments, each MLA may be operated independently and/or in conjunction with one or more other MLAs at one or more stages. For example, the output of two or more cells of a plate may be directed into the input of a single cell of the next plate or stage, allowing plasma beams of possibly different compositions to be combined. Similarly, the output of a cell of a plate may be directed into the input of two or more cells of a next plate or stage, allowing a plasma beam to be separated into beams of possibly different compositions.

An MPC may be constructed to be of any appropriate dimensions. Possible dimensions of an MPC, however, may be dictated by manufacturing limits used to create the plates comprising the MPC. In some embodiments, the plates are constructed from a set of semiconductor die. In such cases, the mechanical saws used to cut the die from a wafer set the minimum limit on the width and height of the plates. For example, current manufacturing methods employed in the semiconductor industry permit a minimum width and height of one millimeter for an MPC. However, smaller minimum dimensions may be achievable as semiconductor technologies improve. For instance, production limits smaller than a millimeter may be achieved using a method of chemical etching that is employed, for example, in the fabrication of radio frequency identification devices. In some embodiments, the upper range of the width and height of an MPC is limited to several centimeters by the optical field size of the photolithography equipment used to create the plates. The thickness of each plate, the spacing between plates, and the number of plates determine the length of an MPC, e.g., length 104 in FIG. 1A. For example, the length of an MPC may vary from less than a millimeter upwards to several centimeters. In some embodiments, the minimum thickness of a plate is based on existing chemical-mechanical methods for thinning semiconductor wafers, and the maximum thickness of a plate is set by the thickness of semiconductor wafers. For example, the thickness of each plate may be from a minimum of twenty-five microns to a maximum of two millimeters. The spacing between the plates depends on the thickness of the adhesive used between plates. For example, an adhesive may have a thickness of a few microns. The number of plates depends on the specific application. For example, a dozen to over hundreds of plates may be employed.

The cells of an MPC may be fabricated to be any appropriate size. However, the minimum cell size may be limited by semiconductor manufacturing limits. Cells of increasingly smaller sizes may be achievable as semiconductor manufacturing techniques improve. For example, the principles of scaling of Moore's Law apply to cell size. Example dimensions of a cell are a width and height of one hundred microns and a depth (which corresponds to plate thickness) of twenty-five microns. A cell of such dimensions has a volume of 25×10-14 cubic meters. An MPC with a length of one hundred plates, each of which is twenty-five microns thick, and a width and height of one centimeter would contain one million cells of the given dimensions, which translates to four million cells per cubic centimeter.

The relative voltages between cells determine the strength of the electromagnetic field associated with any given cell. In some cases, the maximum strength of the electromagnetic field that may be associated with a cell is limited by the vacuum voltage breakdown on the surface of the electrodes creating the field. For example, one hundred million volts per meter may be considered as the highest field strength achievable for a purely static electric field before breakdown. The distance between the electrodes creating the electromagnetic field associated with a cell is approximately equivalent to the depth of the cell. A cell that has a depth of twenty-five microns may, for example, have a maximum achievable electric field strength of twenty-five hundred volts per cell. With such field strengths, for example, an MPC having a length of one centimeter and comprising four hundred plates, each twenty-five microns thick, could provide an acceleration of up to one million electron volts.

Figure 2A:
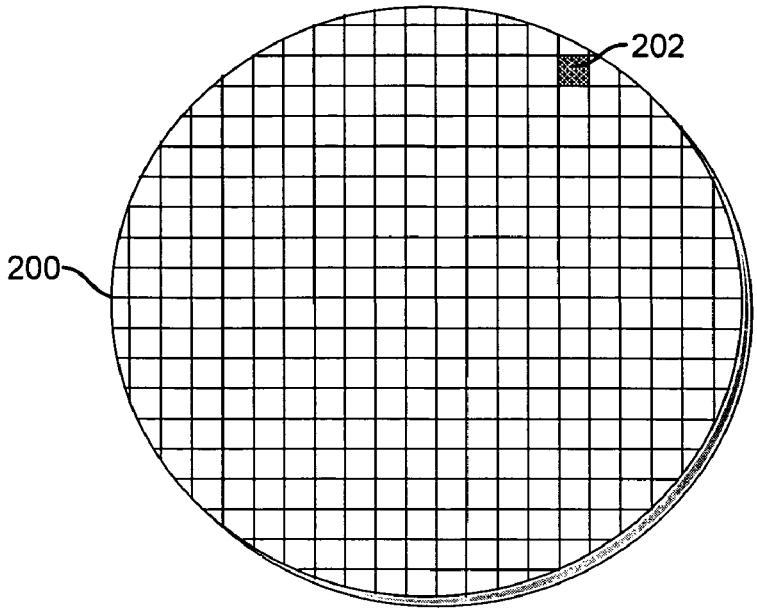
FIGS. 2A-2C are diagrams illustrating various aspects of an embodiment of creating an MPC.
Figure 2B:
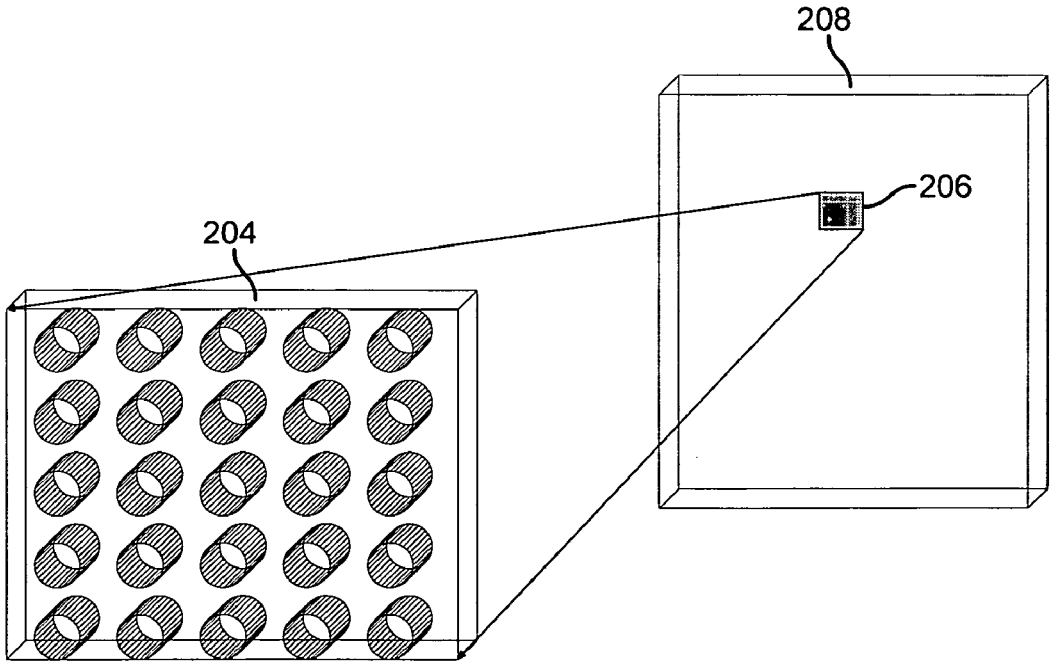
Figure 2C:
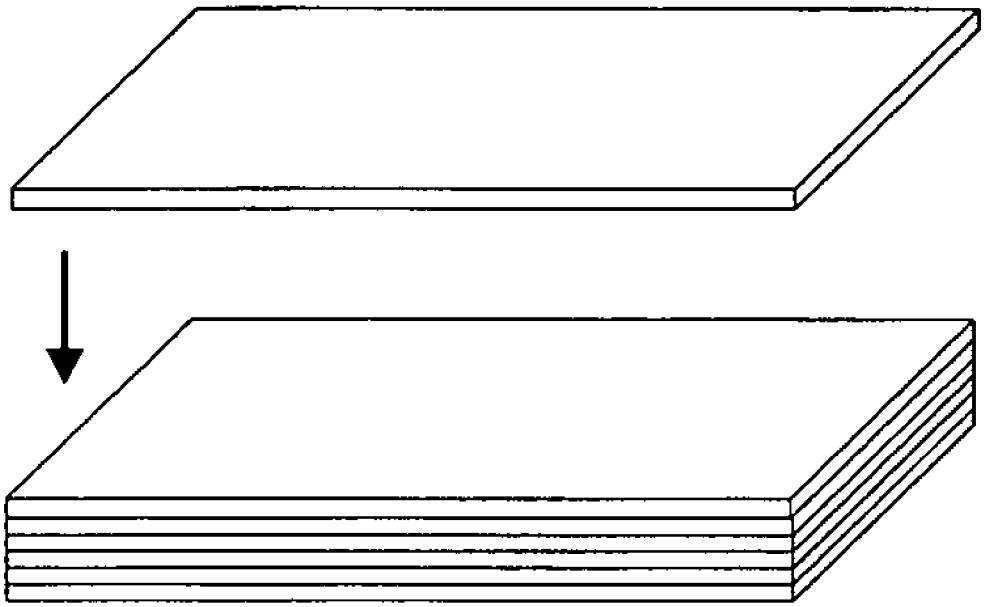

FIGS. 2A-2C are diagrams illustrating various aspects of an embodiment of creating an MPC. In some embodiments, a building block (e.g., a plate) of an MPC is constructed on a semiconductor wafer. FIG. 2A illustrates an example of a semiconductor wafer 200. A semiconductor wafer, for example, may have a diameter of four hundred millimeters and a thickness of several millimeters. The minimum thickness of the wafer is set to prevent breakage of the wafer during the fabrication process. The active region containing active circuits is included on the front side of the semiconductor wafer. The thickness of the active region, for example, may be in the range of ten microns. The wafer is divided into die, such as die 202, separated by thin channels of inactive regions which are employed to saw the wafer into individual die. For a typical die size of one square centimeter, a wafer such as wafer 200 may include over one thousand individual die. Following the wafer manufacturing process, the wafer undergoes a back-end process. In the back-end process, for example, a protective coating is applied to the active front side, and the thickness of the wafer is reduced, e.g., the wafer is placed into a machine that removes material from the backside using a combination of chemicals and mechanical grinding. Current techniques, for example, allow the thickness to be reduced to up to twenty-five microns. Following thinning, multiple cavities are etched into the back of each die. FIG. 2B illustrates an example of the set of cavities 204 etched into a die 206. Each cavity forms the basis of a cell, i.e., plasma may be accelerated through the cavity of the cell. In some embodiments, the etching process alternates etching steps with chemical depositions so that cavities with substantially straight walls can be created. Following the creation of the cavities, the wafer may be tested so that defective die can be identified. Following testing, a slightly sticky elastic membrane is attached to the back of the wafer, and a computer-controlled saw is employed to cut the wafer into one or more plates. As depicted in FIG. 2B, each plate 208 comprises multiple die, such as die 206. Multiple plates are aligned and stacked to form an MPC. FIG. 2C illustrates an example of plates being stacked to form an MPC. A computer controlled robot using a vacuum pickup head may be employed to remove the membrane from each plate. An adhesive is applied to the backside of each plate so that the plates glue together when they are stacked. The plates are stacked such that the cavities of the cells of the plates are aligned and as a result create tubes along the length of the MPC. The alignment accuracy of currently available assembly robots, for example, is less than plus or minus one micron.

Figure 3A:
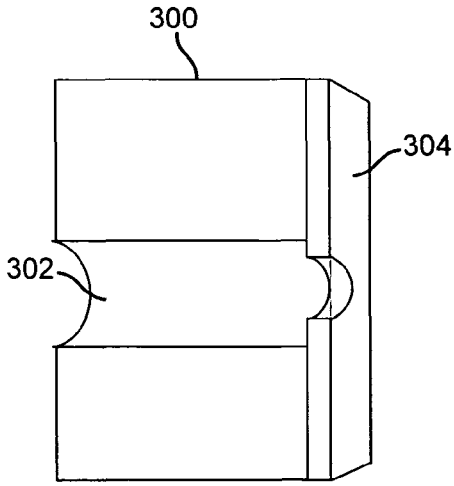
FIGS. 3A-3J are diagrams illustrating embodiments of various aspects of a cell.
Figure 3B:
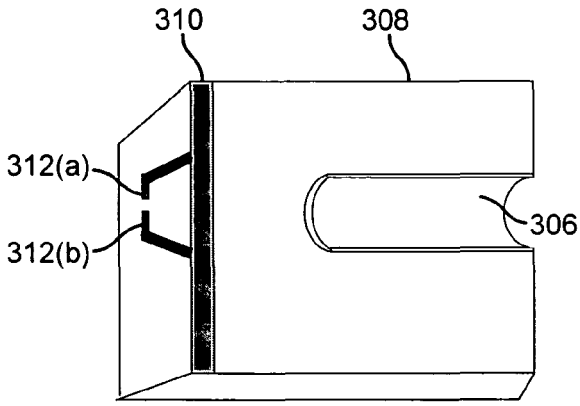

In some embodiments, a cell includes three major components: a cavity, control electronics, and electrodes. FIGS. 3A-3J are diagrams illustrating embodiments of various aspects of a cell. FIG. 3A illustrates an embodiment of a cell cross-section. As depicted, cell 300 includes cavity 302 and active region 304. The charged particles of a plasma occupy the space provided by the cavity, and the control electronics of a cell are included in the active region. The electrodes of a cell are used, e.g., in conjunction with the electrodes of an adjacent cell, to create an electromagnetic field in the cavity of a cell that accelerates the charged particles of a plasma as they travel through the cavity, and the control electronics are used to control the electrodes of a cell. In some embodiments, the cavity of a cell is etched through a silicon die using backside deep etching. FIG. 3B illustrates an example of a cavity etch that is in progress. As depicted, cavity 306 is being etched into die 308. In some embodiments, the placement of a cavity is anticipated during the wafer fabrication process by the introduction of an etch stop layer, such as etch stop layer 310 depicted in FIG. 3B. In such cases, for example, the etch stop layer may be used to control the opening of the cavity through the electrodes, such as electrode segments 312, such that the electrodes are cantilevered over the cavity opening.

Figure 3C:
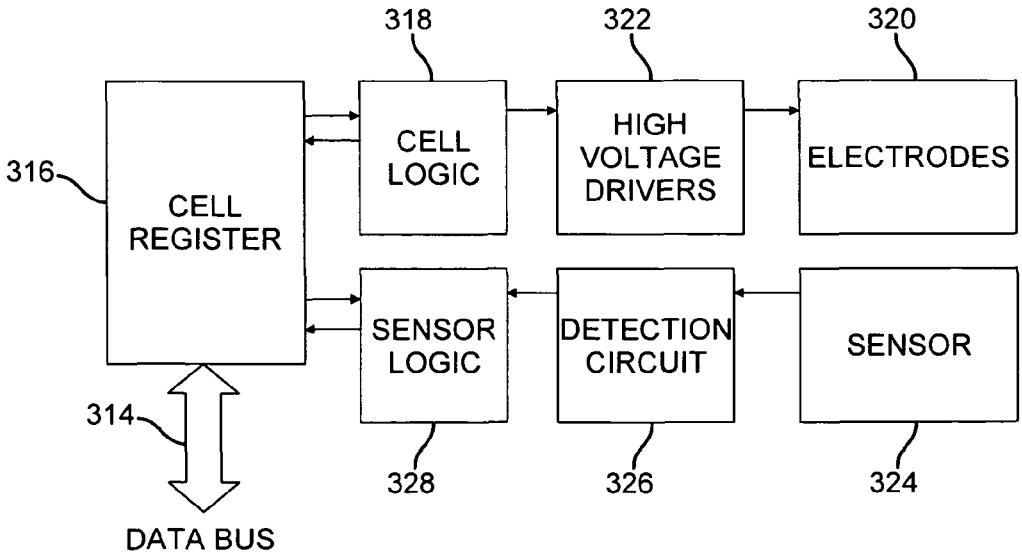

FIG. 3C is a block diagram illustrating an embodiment of components associated with a cell. In some embodiments, a programmable controller controls the cells of each plate. For example, each cell of an MPC or each cell of a given plate is uniquely addressed, and the controller is connected to a data bus, e.g., data bus 314, included on each plate to send and receive data to and from the electronics that control the individual cells. Such a data bus, for example, may comprise an eight-bit data bus. In the example of FIG. 3C, data bus 314 connects to cell register 316, which buffers data addressed to that cell and makes the data available to cell logic 318. The data received by cell logic 318 may comprise commands that establish the real-time behavior of the cell. For example, cell logic 318 may determine the timings and the values of the voltages to be applied to electrodes 320 from received electrode data. In some embodiments, such data may be pre-programmed at the cell. Cell logic 318 drives high voltage drivers 322 associated with electrodes 320. Electrodes 320 are used to draw together the charged particles comprising a plasma into a beam which, in turn, may be accelerated by the electrodes. Sensor 324 detects one or more parameters of the beam. In some embodiments, the sensor information provides feedback for the beam acceleration control loop. Sensor 324 connects to detection circuit 326 which converts the sensor data to a digital format. Sensor logic 328 makes the sensor data available to cell register 316. In some cases, detection circuit 326 may be (additionally) directly connected to high voltage drivers 322 so that they can be automatically switched. The purpose of a cell dictates the manner in which it is operated. For example, the electrodes of cells that are used to form a lens may be set to a constant voltage. The electrodes of adjacent cells that are used to form an accelerator may be pre-set to drive to opposite voltage polarities when the presence of an approaching beam is detected by associated sensors, with the phase and frequency locally synchronized at each cell.

Figure 3D:
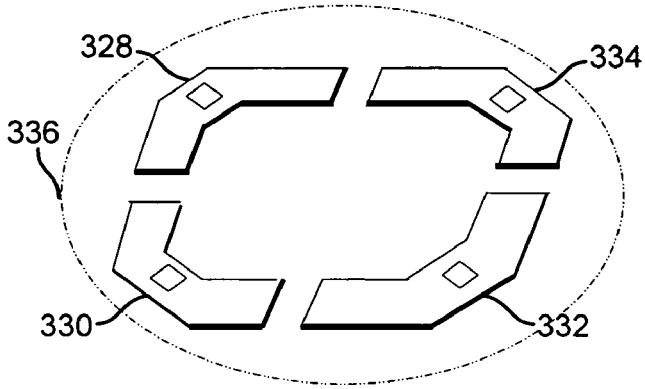

FIG. 3D illustrates an embodiment of the electrodes of a cell. In the given example, four independent electrodes 328-334 are employed to accelerate and/or control the deflection of a plasma beam traveling through the cell cavity. The cavity is depicted in FIG. 3D by outline 336. A contact associated with each electrode is indicated in FIG. 3D by a small square in the middle of the electrode. The electrodes may be formed, for example, using metal layers that are typically used for interconnects in semiconductor processes. Example dimensions of an electrode are a width of two microns, a length of fifteen microns, and a thickness of less than one micron. The electrodes can be supported over the cavity by cantilever microstructures.

Figure 3E:
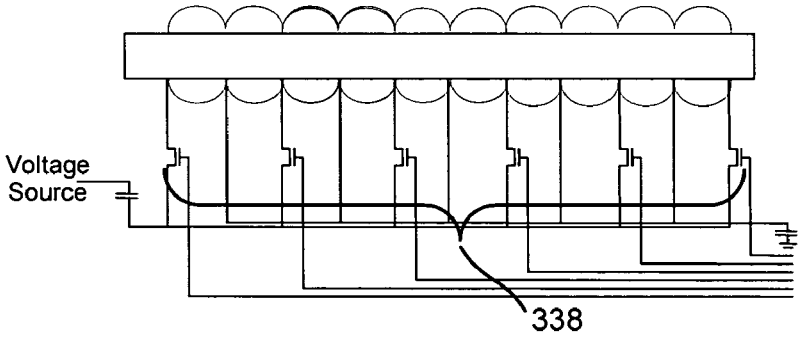
Figure 3F:
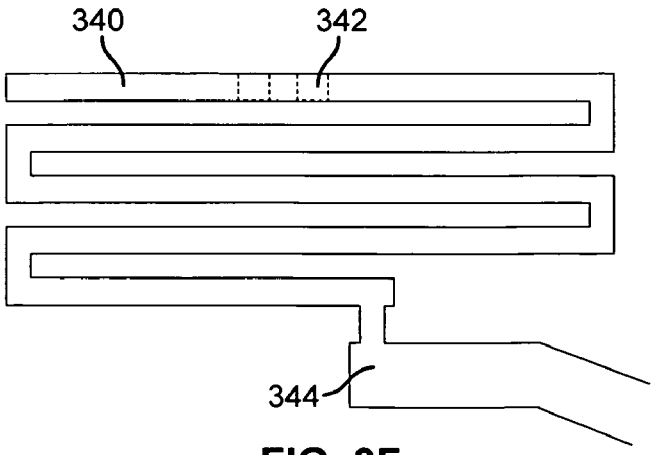

The acceleration of a beam between cells (e.g., of an MLA) depends on the strength of the electromagnetic field created by the electrodes of adjacent cells. An electric field strength of twenty-five hundred volts is possible, for example, with an average cell depth of twenty-five microns and a voltage breakdown of one hundred million volts per meter. In some embodiments, high speed transistors are employed to ensure that the appropriate fields are generated in the various stages of an MLA as a beam travels through. For example, transistors with switching speeds of at least twenty-five gigahertz may be employed. Such transistors may have breakdown voltages that are, for example, greater than ten volts. In some embodiments, a transformer may be employed to drive the electrodes of a cell to voltages that are multiples of the individual breakdown voltages of the transistors. FIG. 3E illustrates an embodiment of a transformer scheme that includes a set of high speed, high voltage transistors 338. The transformer scheme of FIG. 3E, for example, may comprise high voltage drivers 322 in the block diagram of FIG. 3C. Sequentially pulsed inductors of the transformer charge the voltage applied to the electrodes of a cell. Using such a scheme, for example, a set of one hundred transistors may be employed to drive the electrodes of a cell to a positive one thousand volts, and the electrodes of an adjacent cell (e.g., in the previous stage) can be similarly driven to a negative one thousand volts, creating an effective field through the cavity of the cell of two thousand volts. FIG. 3F illustrates an embodiment of the layout of a portion of a high voltage transformer such as the transformer depicted in FIG. 3E. Specifically, FIG. 3F illustrates primary inductor 340, secondary inductor 342, and electrode 344. In some embodiments, metal traces are patterned to form the primary inductor of the transformer. The inductors may be laid out in a serpentine pattern to conserve area in a cell. In some embodiments, the drive transistors (e.g., transistors 338 of FIG. 3E) are placed beneath the secondary inductor and connect through contacts to a metal layer that forms the primary inductor.

Figure 3G:
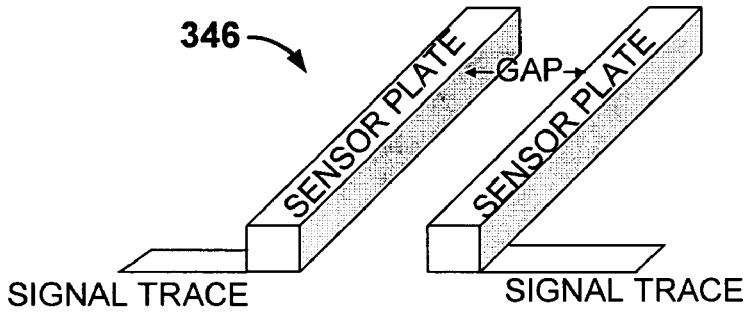
Figure 3H:
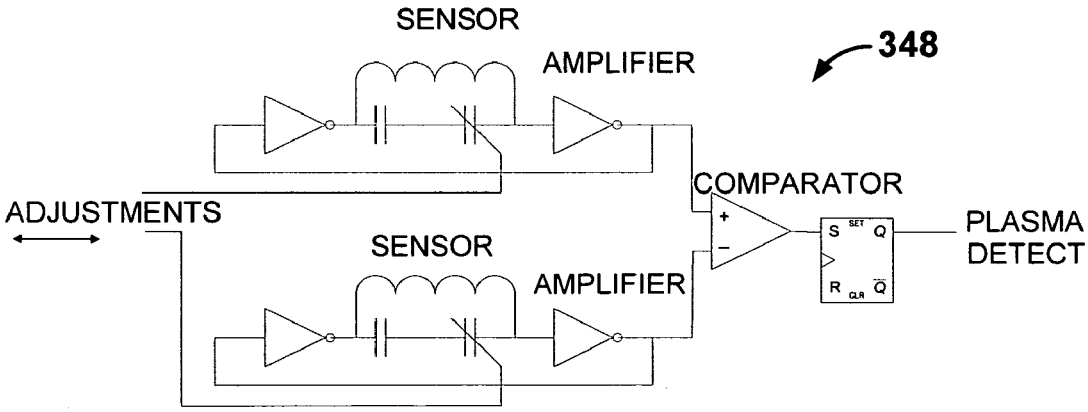

The sensor associated with a cell is employed to detect the presence and/or intensity of the plasma beam passing through the cell. The sensors of the cells are important to the timing circuits, which trigger high voltage pulse generation to sequentially accelerate the beam from plate to plate (i.e., stage to stage). FIG. 3G illustrates an embodiment of the structure of a sensor 346. For example, sensor 324 in the block diagram of FIG. 3C may be similar to sensor 346. In some embodiments, a sensor is fabricated using the topmost metal layers in a semiconductor process. For example, two parallel metal traces may be laid down with the minimum allowable separation. The capacitor formed by the side-walls of the metal traces is placed near the cavity of the cell. As the beam approaches the sensor, the inter-gap dielectric will change from a vacuum as charged particles enter the gap. FIG. 3H illustrates an embodiment of a plasma detection circuit 348. Detection circuit 348, for example, may comprise detection circuit 326 of FIG. 3C. In some embodiments, plasma detection circuit 348 includes a dummy sensor placed out of range of the plasma beam, and a deferential circuit is employed to detect the voltage difference between the dummy sensor and the actual sensor used to detect the beam. The dummy sensor reduces the common mode noise into the deferential circuit.

Figure 3I:
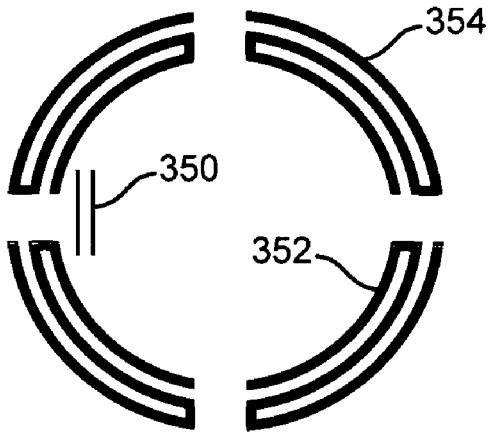
Figure 3J:
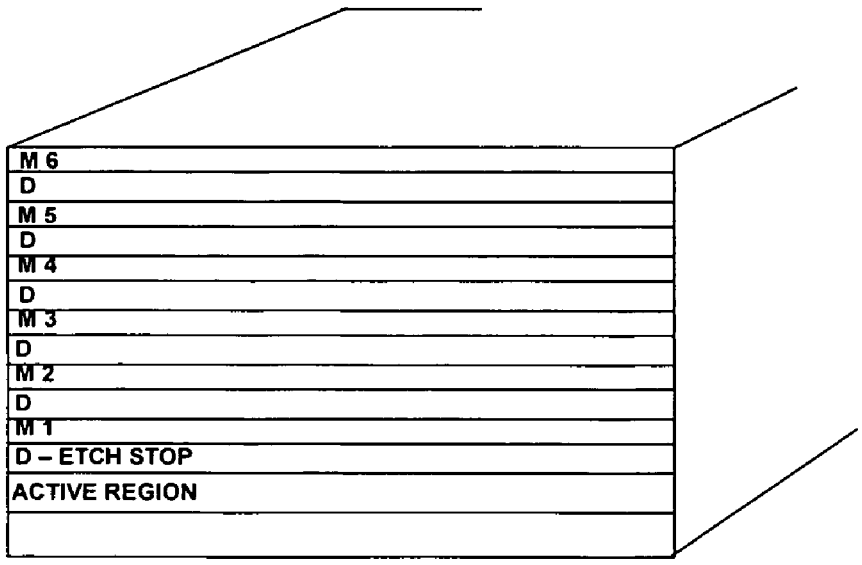

FIG. 3I illustrates an embodiment of the topmost metal layer of a cell. The topmost metal layer may be employed, for example, to form one or more sensors 350, electrodes 352, and/or transformer primary inductors 354. As depicted in FIG. 3I, the layout of the topmost layer is positioned around the cavity with the sensors inner-most, followed by the electrodes and the primary inductors. FIG. 3J illustrates an embodiment of the metal (M) and dielectric (D) layers of a semiconductor process. In some embodiments, the electrodes may be embedded within the layer stack-up. For example, the top most metal layer M6 may be used for one electrode, and metal layer M1 may be used for another electrode. In some embodiments, the drive circuits for all of the electrodes may be included within a single die.

Figure 4A:
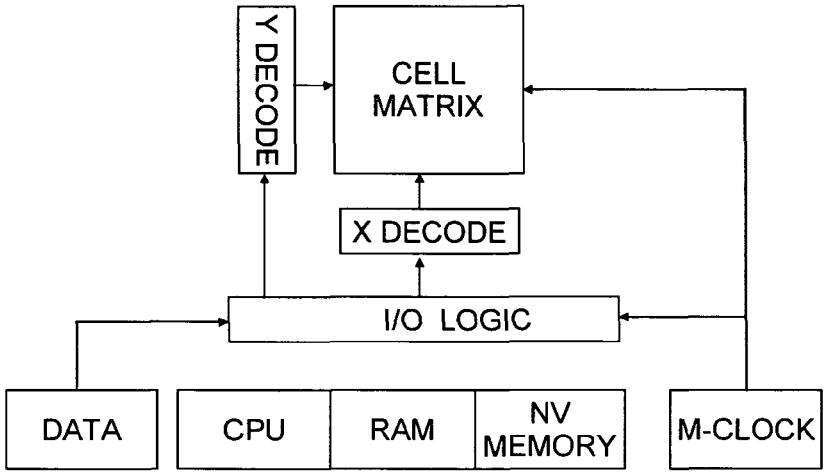
FIGS. 4A-4C are diagrams illustrating embodiments of various aspects of a plate.
Figure 4B:
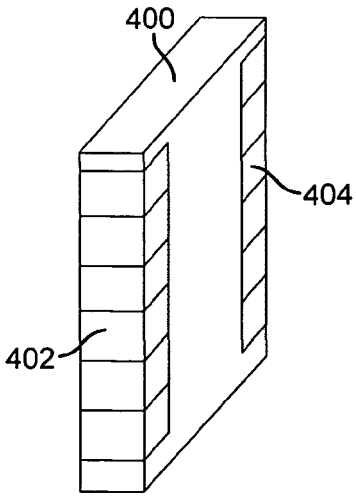
Figure 4C:
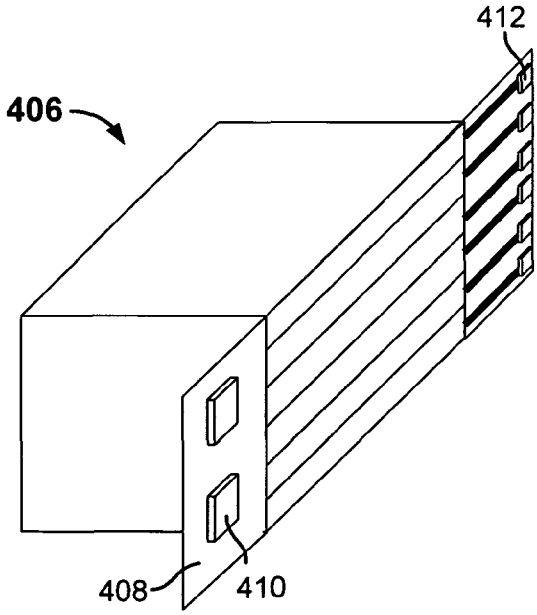

FIGS. 4A-4C are diagrams illustrating embodiments of various aspects of a plate. FIG. 4A is a block diagram illustrating an embodiment of electronics associated with a plate. In some embodiments, each plate includes a programmable digital controller comprising a central processing unit, memory, input/output circuits, etc. The controller may send and receive external commands, e.g., to and from an external controller. In such cases, the controller interprets received external commands and communicates instructions to the appropriate cells, e.g., via a data bus, such as data bus 314 of FIG. 3C. In some embodiments, local, independent cell processors control plasma beam acceleration at each cell. FIG. 4B illustrates an embodiment of the conductive regions of a plate 400. As depicted, conductive regions 402 and 404 may be formed at the edges of a plate to provide external connection since plates are stacked to form an MPC. An edge may be made conductive by heavily doping the region. Electrical power may be provided to the plates through the edges. For example, multiple metal contacts may connect the doped region to power planes. Similarly, an edge may be employed to form a data connection between the plate and an external controller. An MPC is created by stacking a plurality of plates. FIG. 4C illustrates an embodiment of a complete stand-alone assembly of an MPC 406 that is compact and readily connectable to the outside world. Once the plates are stacked, a printed circuit board 408 may be attached to an edge using a conductive adhesive. Decoupling capacitors, such as decoupling capacitor 410, may be attached to the circuit board to filter high speed power variations. MPC 406 may be connected to an external controller through one or more edge connectors such as edge connector 412.

As described, in some embodiments, an electrostatic accelerator may be established between cells. The energies of the particles comprising the beam increase as the particles are accelerated at increasing speeds from stage to stage. As the particles accelerate, the cell timing may be automatically adjusted by the cell's circuitry to compensate for increases in velocity. Thus, stages of the accelerator can be constant length, rather than constant time of flight. As described, controlling the thickness of the wafer fixes the constant length of each stage in some embodiments. The automation of timing allows an MPC to adjust for a wide range of particle parameters. Each MLA of an MPC may be controlled independently of other parallel MLAs. Each stage in an MLA may be controlled independent of the other stages in the MLA. In addition to and/or instead of acceleration, the electrodes of a cell may be employed to steer and/or focus a beam (e.g., to reduce beam divergence), which may be achieved, for example, by applying different voltages to different electrodes (e.g., electrodes 328-334 of FIG. 3D) of the cell.

Figure 5A:
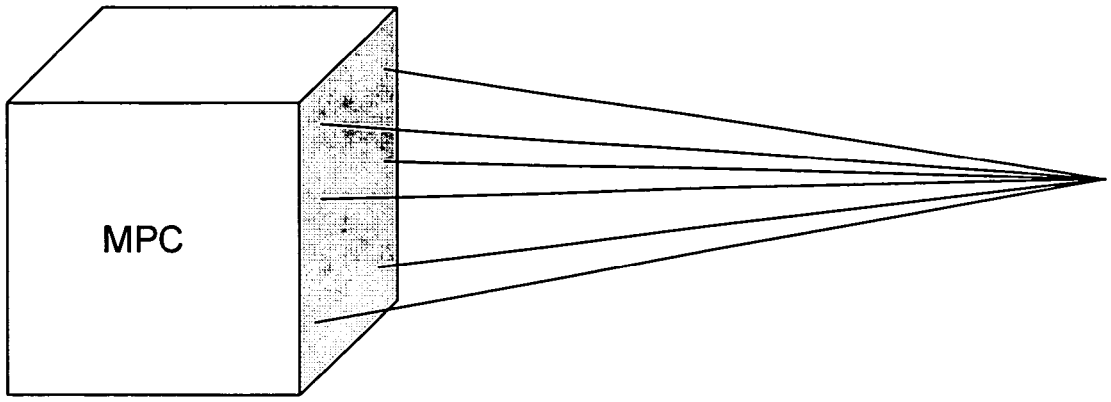
FIGS. 5A-5D are diagrams illustrating some embodiments of output beam patterns.
Figure 5B:
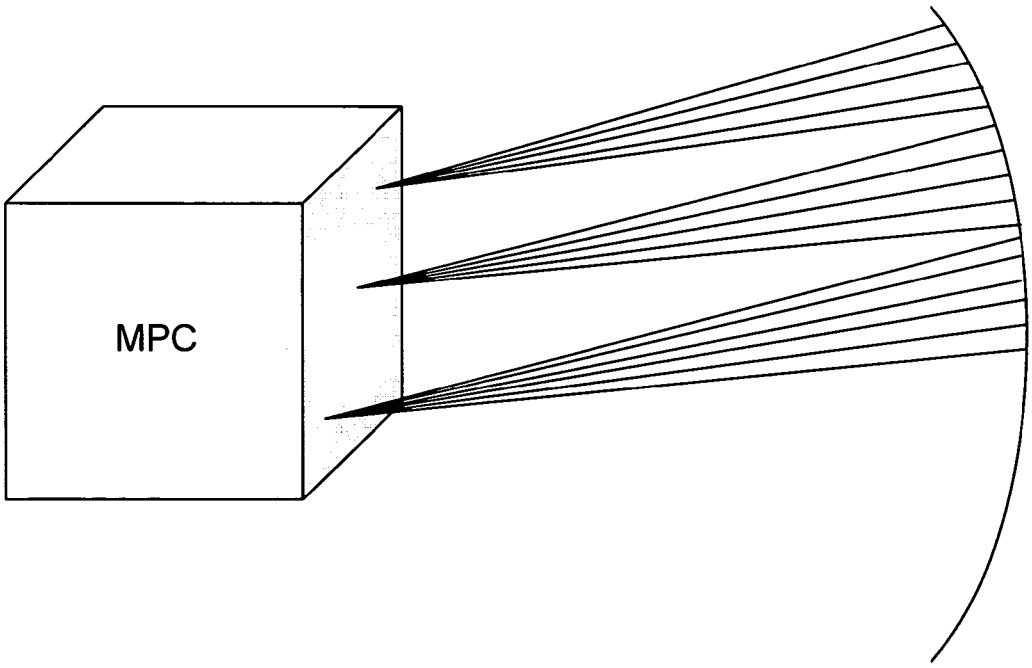
Figure 5C:
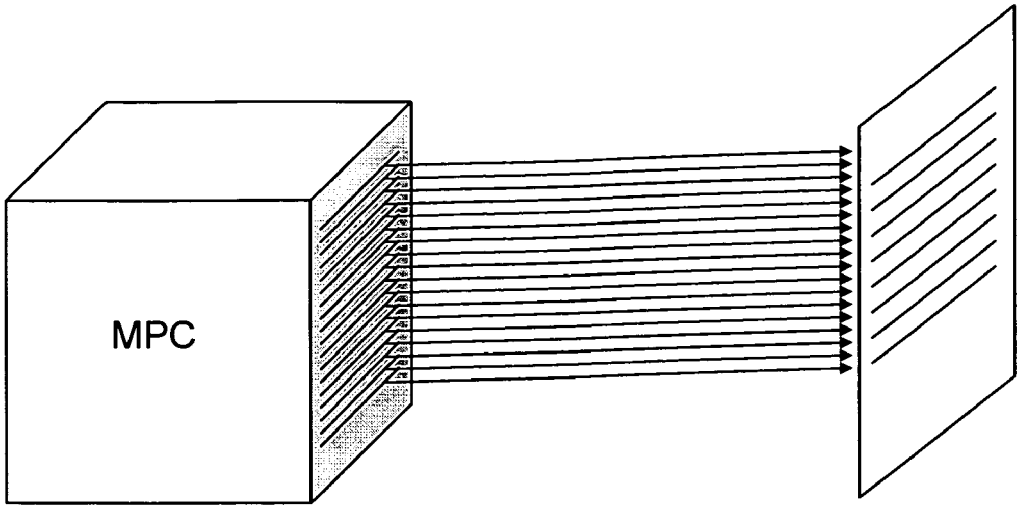
Figure 5D:
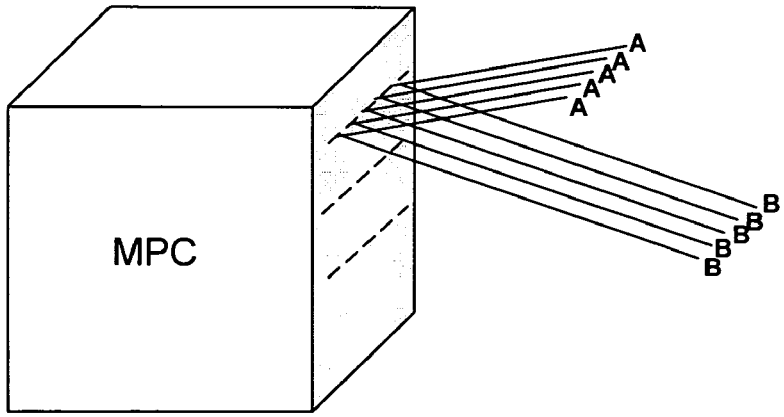

Each output beam of an MPC may be individually controlled and programmed to have a desired velocity and direction. A wide variety of output beam patterns may be achieved in various embodiments. FIGS. 5A-5D are diagrams illustrating some embodiments of output beam patterns. FIG. 5A illustrates an embodiment in which all (or at least several) beams are directed to a single focal point. In this example, the MPC functions as a plasma lens. The energy of each beam is additive, with the total energy at the focal point equal to the sum of the energies of the individual beams. If desired, the focal point of the beams may be varied in time allowing the beam to scan over an area. FIG. 5B illustrates an embodiment in which different beams are focused to different points, e.g., similarly to multiple raster scans. Beam scanning can be implemented by changing the location of the focal point of each beam over time. In FIG. 5B, for instance, each fan shows the locations of the focal points of a particular beam at five different times. FIG. 5C illustrates an embodiment in which each beam has a fixed focal point but different beams are turned on and off sequentially in time, e.g., similarly to a full raster scan. As a result, different locations on the screen depicted in FIG. 5C are sequentially illuminated. FIG. 5D illustrates an embodiment in which an MPC is being used for particle separation. As depicted, an MPC can be used to separate an input plasma consisting of different types of particles into individual beams, each having a different composition and/or associated with a particular particle type.

An MPC provides control over atomic and subatomic particles, leading to applications in many fields. Potential applications areas include, but are not limited to, for example, (maskless) ion implantation processes in semiconductor manufacturing; isotope separation; particle beam therapy in medical applications; imaging systems including imaging systems based on the photo-multiplier effect; holographic, sub-microscopic, and/or high speed photographic quality printing applications; high density (e.g., hundred of million of pixels) and/or three-dimensional displays; high bandwidth multiplexers, amplifiers, and/or antennas in communication systems; mass storage systems that are of high density and/or have fast read and write capabilities; optical message switching in networking applications; pixel x-ray applications; high energy physics applications; nanochemistry; spectography applications; desktop accelerators; quantum computing; etc.

Figure 6A:
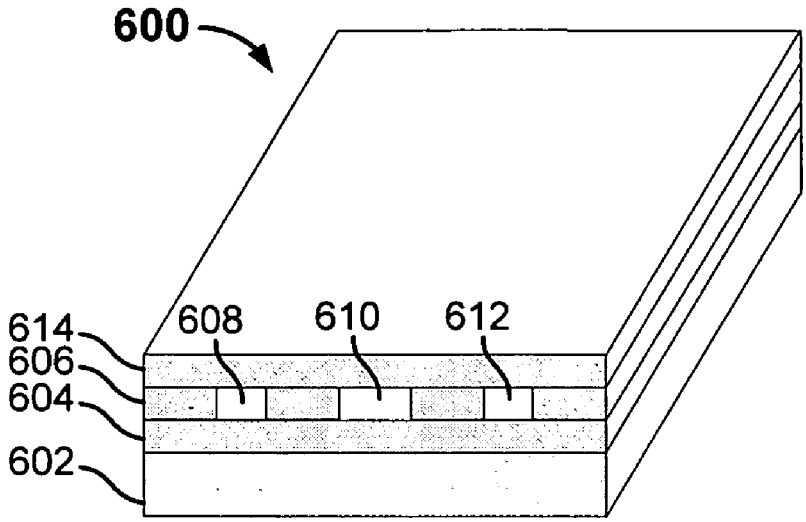
FIGS. 6A-6B are diagrams illustrating an embodiment of a planar configuration of a die.
Figure 6B:
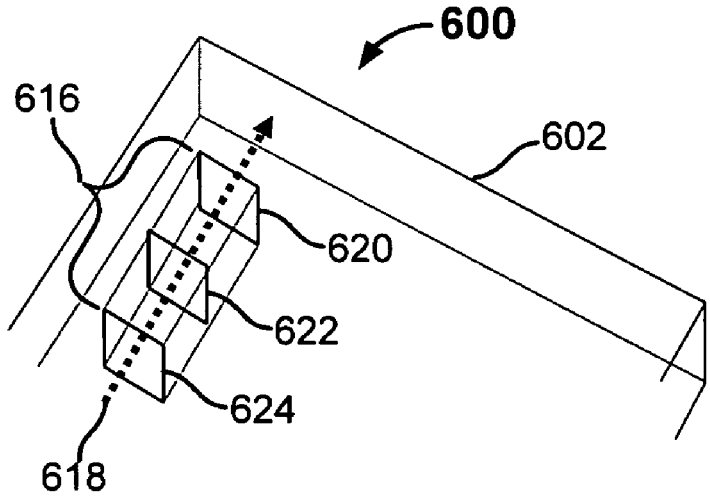

In some embodiments, the cavities of a die may be longitudinally positioned along the top surface of the die. FIGS. 6A-6B are diagrams illustrating an embodiment of such a planar configuration of a die. In the example of FIG. 6A, die 600 includes substrate 602, active area 604, layer 606 that includes cavities 608-612, and dielectric 614. Cavities 608-612 are positioned on top of active area 604. A semiconductor die is typically packaged using a post-process technique known as "wafer packaging" or "die bumping" that adds metal and/or dielectric layers to the wafer, for example, after the completion of wafer fabrication and testing. The cavities may be created using such a layer. The layer thicknesses used in wafer packaging, for example, may be in the range of three to five microns. Thus, the cavities would have cross sections corresponding to the thickness of the layer used, e.g., three to five microns. With a ten micron pitch between cavities, for instance, a two centimeter by two centimeter die could contain twenty thousand cavities. Multiple die and/or plates may be arranged to create an MPC and/or an MLA of an MPC. FIG. 6B illustrates a cross-section of the planar configuration of FIG. 6A. The cross-section depicts substrate 602 of die 600, cavity 616 (which may, e.g., correspond to one of cavities 608-612), plasma beam 618 traveling through cavity 616, and electrodes 620-624. In some embodiments, the electrodes in the planar configuration are contained within the cavities. For example, the electrodes may be formed by using a metal layer for the bottom rail, vias for the rails, and a metal layer for the top rail. The sequence of process steps used to create the electrodes within the cavities may employ a photoresist layer that is used as a support layer for the top metal rail. After the metal rail is completed, the photoresist is removed, exposing the metal layer over the open cavity. A layer of dielectric, e.g., 614 in FIG. 6A, forms the top layer of die 600. The dielectric may be applied using common spin-on techniques with the surface tension of the material kept sufficiently high to bridge the cavity openings.

Although examples of various aspects of an MPC have been described, any other appropriate techniques and/or combination of techniques may be employed to construct such a device. For example, instead of generating high voltages using a transformer for each cell such as the transformer scheme depicted in FIG. 3E, high voltages may be supplied from an attached printed circuit board (e.g., 408 in FIG. 4C), and one or more high voltage transistors may be employed to switch the voltages to the electrodes. In various embodiments, the plates of an MPC may be of any size and shape, e.g., square, rectangular, circular, etc. In some embodiments, a high power laser may be employed to shape a silicon die into any arbitrary shape desired for the plates. As an alternative to semiconductor material, the plates of an MPC may be manufactured using any other appropriate material that can be used as a substrate. Examples include printed circuit boards, ceramic hybrids, liquid crystal display substrates, thin-film on polished materials, etc. In such cases, the semiconductors can be attached using any appropriate back-end technology such as solder or gold bump die, wire-bonded die, wafer-level packaged die, plastic packaged die, ceramic packaged die, etc.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A particle controller, comprising:

an input port configured to receive a particle stream;

a semiconductor cell comprising a cavity through which at least a portion of the particles comprising the particle stream is directed; and one or more electrodes coupled to the cavity and configured to facilitate creation of an electromagnetic field for directing the at least portion of particles through the cavity;

wherein the cell is part of a set of semiconductor cells whose cavities are aligned to form a tube through which the at least portion of particles is directed.

2. A particle controller as recited in claim 1, wherein the particles comprising the particle stream are charged particles.

3. A particle controller as recited in claim 1, wherein the particles comprising the particle stream are in a plasma state.

4. A particle controller as recited in claim 1, wherein the at least portion of particles is directed through the tube according to electromagnetic fields created across cavities of the set of cells by electrodes of adjacent cells.

5. A particle controller as recited in claim 1, wherein each cell is associated with control electronics configured to control the electrodes of that cell.

6. A particle controller as recited in claim 1, wherein one or more high speed transistors are employed to at least in part control a voltage supplied to the electrodes of each cell.

7. A particle controller as recited in claim 1, wherein electrodes associated with adjacent cells in the set of cells create a potential difference in a cavity associated with each cell.

8. A particle controller as recited in claim 1, wherein the cells in the set are each of a same length.

9. A particle controller as recited in claim 1, wherein the set of cells comprises an accelerator, with each cell comprising a stage of the accelerator.

10. A particle controller as recited in claim 1, wherein the set of cells comprises a lens that focuses the at least portion of particles into a beam.

11. A particle controller as recited in claim 1, wherein the set of cells comprises a set of adjacent cells along a length of the particle controller and further comprising a set of plates wherein each plate in the set of plates includes a set of cells associated with that plate which set of cells associated with that plate includes one cell included in the set of adjacent cells.

12. A particle controller as recited in claim 11, wherein the plates included in the set of plates are stacked together and form a set of parallel tubes including the tube.

13. A particle controller as recited in claim 12, wherein each plate in the set of plates is associated with a stage of the set of tubes.

14. A particle controller as recited in claim 11, wherein each plate comprises one or more semiconductor die.

15. A particle controller as recited in claim 1, further comprising one or more output ports configured to output one or more particle beams formed from the particles comprising the particle stream.

16. A particle controller as recited in claim 1, wherein the input port is part of a plurality of input ports configured to receive one or more particle streams.

17. A particle controller as recited in claim 1, wherein the particle controller comprises an integrated circuit.

18. A method for controlling a particle stream, comprising:

receiving a particle stream at an input port;

directing at least a portion of the particles comprising the particle stream through a cavity of a semiconductor cell; and configuring one or more electrodes coupled to the cavity to facilitate creation of an electromagnetic field for directing the at least portion of particles through the cavity;

wherein the cell is part of a set of semiconductor cells whose cavities are aligned to form a tube through which the at least portion of particles is directed.

19. A method for controlling a particle stream, comprising:

receiving a particle stream at an input port; and directing at least a portion of the particles comprising the particle stream through cavities of a set of semiconductor cells aligned to form a tube;

wherein the at least portion of particles is directed through the tube according to electromagnetic fields created across cavities of the set of cells by electrodes of the cells and wherein the cells in the set are each of a same length.

20. A computer program product for controlling a particle stream, the computer program product being embodied in a computer readable storage medium and comprising computer instructions for:

receiving a particle stream at an input port;

directing at least a portion of the particles comprising the particle stream through a cavity of a semiconductor cell; and configuring one or more electrodes coupled to the cavity to facilitate creation of an electromagnetic field for directing the at least portion of particles through the cavity;

wherein the cell is part of a set of semiconductor cells whose cavities are aligned to form a tube through which the at least portion of particles is directed.

* * * * *